United States Patent [19]

Goodman

[11] Patent Number: 4,999,125

[45] Date of Patent: Mar. 12, 1991

[54] GRANULES OF A DETERGENT COMPONENT COATED WITH AN ORGANOPHILIC CLAY

[75] Inventor: Howard Goodman, St. Austell, United Kingdom

[73] Assignee: ECC International Limited, United Kingdom

[21] Appl. No.: 499,166

[22] Filed: Mar. 26, 1990

[30] Foreign Application Priority Data

Mar. 31, 1989 [GB] United Kingdom ..... 8907346

[51] Int. Cl.[5] ..... C11D 7/42; C11D 17/08; C11D 17/06; C11D 7/20

[52] U.S. Cl. ..... 252/90; 252/95; 252/301.21; 252/301.34; 252/186.25; 252/91; 252/186.38; 252/174.12; 252/174.13; 252/547; 252/528; 252/543; 252/174.25; 264/117; 427/212; 427/219; 427/221

[58] Field of Search ..... 252/174.25, 174.13, 252/547, 528, 8.8 R, 90, 95, 91, 301.21, 301.34, 186.25, 186.38, 543; 427/212, 219, 221; 264/117

[56] References Cited

U.S. PATENT DOCUMENTS

| | | | |
|---|---|---|---|
| 3,594,212 | 7/1971 | Ditsch | 117/62 |
| 3,852,211 | 12/1974 | Ohren | 252/110 |
| 4,062,647 | 12/1977 | Storm et al. | 8/137 |
| 4,196,104 | 4/1980 | Oguagha | 252/542 |
| 4,199,465 | 4/1980 | Rodriguez | 252/91 |
| 4,292,035 | 9/1981 | Battrell | 8/137 |
| 4,339,335 | 7/1982 | Wixon | 252/8.8 |
| 4,411,809 | 10/1983 | Wixon | 252/91 |
| 4,421,657 | 12/1983 | Allen | 252/8.6 |
| 4,569,773 | 2/1986 | Ramachandran et al. | 252/8.7 |
| 4,632,768 | 12/1986 | Atkinson | 252/8.8 |
| 4,695,511 | 9/1987 | Goodman et al. | 428/404 |
| 4,806,253 | 2/1989 | Burckett St. Laurent et al. | 252/8.8 |

FOREIGN PATENT DOCUMENTS

| | | |
|---|---|---|
| 0051987 | 5/1982 | European Pat. Off. . |
| 2259898 | 8/1975 | France . |
| 1462484 | 1/1977 | United Kingdom . |

*Primary Examiner*—A. Lionel Clingman
*Assistant Examiner*—Erin M. Harriman
*Attorney, Agent, or Firm*—Klauber & Jackson

[57] ABSTRACT

There is disclosed a granular detergent composition comprising granules of a chemical reagent the surfaces of which are provided with a coating comprising an organophilic clay mineral.

19 Claims, No Drawings

GRANULES OF A DETERGENT COMPONENT COATED WITH AN ORGANOPHILIC CLAY

The invention relates to improved chemical reagent granules suitable for incorporation in a detergent composition and to a process for preparing the granules. More particularly, the present invention provides a method for delaying the release into aqueous solution of a chemical reagent used in a detergent composition.

Enzyme granules of the type used in detergent compositions are sensitive to their surroundings, and their activity tends to decrease with time when mixed with other ingredients to form a detergent composition, even in a relatively dry state. When a detergent composition containing enzyme granules is mixed with water, dissolution of the enzyme is especially rapid, and when the detergent composition also contains granules of a bleaching reagent, the bleaching reagent is also rapidly released into solution and there is a tendency for the enzyme and the bleaching reagent to react with one another, rather than to perform their respective desired functions in the washing and cleaning process. It would clearly be desirable to delay the dissolution of the enzyme and/or the bleaching reagent.

EP-0051987 discloses a granular bleach activator composition comprising at least 55% by weight of a finely-divided organic peroxy acid bleach precursor, from 1% to 25% by weight of an organic binding agent and from 1% to 25% by weight of a finely-divided water-insoluble natural or synthetic silica or silicate.

According to a first aspect of the invention, there is provided a granular chemical reagent for use in a granular detergent composition, the surfaces of the granules of the chemical reagent being provided with a coating comprising an organophilic clay mineral.

The chemical reagent coated may be any one or more of the chemical reagents employed in detergent compositions such as (a) an enzyme, for example, an amylase, a protease, or a lipase, (b) a bleaching reagent such as sodium perborate or diperoxydodecandioic acid, or (c) a bleach activator such as methyl o-acetoxy benzoate, sodium p-acetoxy benzene sulphonate, bisphenol A diacetate, tetra acetyl ethylene diamine, tetra acetyl hexamethylene diamine or tetra acetyl methylene diamine, or (d) an optical brightening agent.

According to a second aspect of the invention, there is provided a process for preparing a granular chemical reagent for use in a detergent composition, which process includes the step of providing the chemical reagent with a coating comprising an organophilic clay mineral.

According to a third aspect of the present invention, there is provided a method for delaying the release of a chemical reagent used in a detergent composition, which method includes the step of providing the chemical reagent with a coating comprising an organophilic clay mineral.

The clay mineral may, for example, be a smectite clay, for example bentonite, montmorillonite, hectorite, saponite, fullers earth or the like. A bentonite of which the major part of the exchangeable cations are sodium ions (a sodium bentonite) is especially suitable. Other bentonites such as calcium bentonite are also suitable. Alternatively, the clay mineral may be a kaolin clay.

The clay mineral may be rendered organophilic by treatment with a quaternary ammonium compound having at least one higher alkyl group containing from 10 to 24 carbon atoms. This is particularly suitable for rendering a smectite clay mineral organophilic.

The quaternary ammonium compound preferably consists of one or more compounds chosen from the group which can be represented by the general formula:

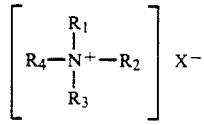

in which $R_1$ is a saturated or unsaturated alkyl group having from 10 to 24 carbon atoms, $R_2$ and $R_3$, which may be the same or different, are each a saturated or unsaturated alkyl group having from 1 to 24 carbon atoms or an aralkyl group having from 7 to 10 carbon atoms, $R_4$ is an alkyl group having from 1 to 6 carbon atoms or an aralkyl group having from 7 to 10 carbon atoms and X is OH, Cl, Br, I, $NO_2$, $CH_3SO_4$ or $CH_3.COO$. Examples of such quaternary ammonium compounds are the methyl benzyl dialkyl ammonium chlorides, the dimethyl dialkyl ammonium chlorides, the dimethyl benzyl alkyl ammonium chlorides, the benzyl trialkyl ammonium chlorides and the methyl trialkyl ammonium chlorides. The alkyl group is most advantageously a mixture of hydrocarbon radicals derived from tallow having from 14 to 20 carbon atoms but in which $C_{18}$ radicals predominate. (A typical analysis of such a mixture of hydrocarbon radicals contained in tallow is: $C_{14}$ 4.5%; $C_{15}$ 0.5%; $C_{16}$ 30.5%, $C_{17}$ 1.5%; $C_{18}$ 62.0% and $C_{20}$ 1.0%). The hydrocarbon radicals may be substantially saturated as a result of, for example, treating the tallow with hydrogen in the presence of a suitable catalyst.

The clay mineral may alternatively be rendered organophilic by treatment with an organic amine, preferably one having at least one higher alkyl group containing from 10 to 24 carbon atoms. The organic amine may be a primary, secondary or tertiary amine of general formula

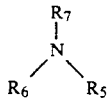

in which $R_5$ is a saturated or unsaturated alkyl group having from 10 to 24 carbon atoms, and $R_6$ and $R_7$, which may be the same or different, are each a hydrogen atom or a saturated or unsaturated alkyl group having from 1 to 24 carbon atoms or an aralkyl group having from 7 to 10 carbon atoms. One presently preferred amine is octadecylamine.

The clay mineral is treated with sufficient of the quaternary ammonium compound or organic amine to render it organophilic. Preferably the clay mineral is treated with sufficient of the quaternary ammonium compound or amine to provide up to 155, and preferably no more than 140, milliequivalents (meq.) of quaternary ammonium compound or amine per 100 g of dry clay. Where the organophilic clay mineral is prepared by a "wet" process, for example one in which a suspension of the clay mineral is mixed with a dispersion of quaternary ammonium compound, the resultant organophilic clay mineral will normally have at least 90 milliequivalents of the quaternary ammonium compound per 100 g of dry clay. It is possible to prepare an organophilic clay mineral containing very much less than 90 meq. of the quaternary ammonium compound or amine by a process of dry mixing the clay mineral with a molten amine or molten quaternary ammonium compound. Further improvements have been achieved when the clay mineral is combined with the quaternary ammonium compound under conditions of strong mixing in order to produce a well dispersed organophilic clay mineral.

The clay mineral should preferably have a particle size such that at least 90% of the particles pass through a No. 200 mesh British Standard sieve (nominal aperture 76 microns).

The chemical reagent granules may be coated with the organophilic clay mineral by, for example, tumbling the granules in a pan granulator while spraying them with a suspension of the organophilic clay mineral in a suitable liquid medium such as a liquid aliphatic hydrocarbon. Alternatively the chemical reagent granules may be mixed with the organophilic clay mineral in substantially dry powder form in, for example, a pan granulator and the mixture sprayed with a liquid binder such as a liquid aliphatic hydrocarbon or an aqueous suspension of an organic polymeric binder which may be, for example, a natural or synthetic polyisoprene, a styrene-butadiene copolymer, a lower alkyl acrylic acid ester - lower alkyl methacrylic acid ester copolymer, a copolymer of a lower alkyl acrylic acid ester and/or a lower alkyl methacrylic acid ester with vinyl acetate, styrene or acrylonitrile, a poly(vinyl acetate), a poly(vinyl alcohol) or a copolymer of vinyl acetate with styrene and/or acrylonitrile.

Preferably the chemical reagent granules are coated with from 0.1 to 20% by weight, based on the weight of dry chemical reagent granules, of the organophilic clay mineral. More preferably, the granules are coated with no more than 10% by weight of the organophilic clay mineral.

Where an organic polymeric binder is used, the amount of this binder is preferably from 1% to 20% by weight, based on the weight of dry chemical reagent granules.

Even more advantageous results are obtained when there is mixed with the organic polymeric binder up to about 15% by weight, based on the weight of dry chemical reagent granules, of a finely divided mineral material. The mineral material may be, for example, a kandite clay mineral, i.e. kaolinite, nacrite, dickite or halloysite, a smectite clay mineral, calcium carbonate, talc, mica or gypsum. Generally not more than about 10% by weight, based on the weight of dry chemical reagent granules, of the finely divided mineral material will be required. It is believed that the particles of the finely divided mineral material serve to seal gaps left on the surface of the chemical reagent granules between the particles of the organophilic clay mineral.

The coated chemical reagent granules of the present invention may be used with advantage in granular detergent compositions, such as conventional washing powders. In such circumstances, the coated reagent of the present invention replaces the uncoated reagent conventionally used.

A typical detergent composition may contain one or more of the following ingredients within the following ranges:

| Ingredient | % by weight |
|---|---|
| Anionic surfactant | 0-25 |
| Nonionic surfactant | 2-35 |
| Suds controlling agent | 0-5 |
| Foaming booster | 0-2 |
| Enzyme granules | 0.1-2.3 |
| Builder | 0-25 |
| Formulation aid | 3-15 |
| Optical brightener | 0.1-0.3 |
| Stabiliser | 0-5 |
| Fabric softener | 0-2 |
| Fragrance, dyestuff and water to | 100 |

The anionic surfactant may be chosen from the group consisting of alkylbenzene sulphonates, soaps and fatty alcohol ether sulphates. The nonionic surfactant may be, for example, an alkyl polyethyleneglycol ether. The suds controlling agent may be, for example, a soap. The foaming booster may be, for example, a fatty acid alkanol amide. The builder may be chosen from the group consisting of potassium diphosphate, sodium triphosphate, sodium citrate and sodium silicate. The formulation aid may be chosen from the group consisting of xylene sulphonates, ethanol and propylene glycol. The optical brightener may be, for example, a stilbenedisulphonic acid-bis-(styryl)-biphenyl derivative.

The stabiliser may be triethanolamine or another complexing agent. The fabric softener may be a smectite clay or a quaternary ammonium compound.

The invention will now be illustrated by the following examples.

EXAMPLE 1

In this example 100 g of enzyme granules comprising an amylase concentrate and a suitable binder and having diameters substantially within the range from 0.5 to 1.0 mm were tumbled in a pan granulator and were mixed with

| | |
|---|---|
| either A: | 10 g of a natural hydrophilic calcium bentonite having a particle size distribution such that 99% by weight passed through a No. 300 mesh British Standard sieve (nominal aperture 53 microns). |
| or B: | 7 g of a Wyoming sodium bentonite which had been treated with sufficient dimethyl di(hydrogenated tallow) ammonium chloride (2M2HT) to provide 135 milliequivalents of 2M2HT per 100 g of dry bentonite and having a particle size distribution such that 99% by weight passed through a No. 200 mesh British Standard sieve (nominal aperture 76 microns). |

The substantially dry mixture of enzyme granules and either A or B was sprayed with a known weight of

| | |
|---|---|
| (a) | water |
| or (b) | a styrene-butadiene rubber latex containing 50% by weight of latex solids (SBR latex) |
| or (c) | odourless mineral spirit - a substantially aliphatic liquid hydrocarbon (OMS) |

The coated granules were then dried in a vacuum oven at 60° C. In a cylindrical vessel which had a base portion which was separated from the body of the vessel by a millipore filtration membrane having a pore size of 0.45 microns there was then placed 300 ml of distilled water. The base portion was provided with an outlet for filtrate passing through the membrane, the outlet being closable with a valve. The vessel was also provided with a close fitting lid provided with an inlet for connection to a supply of air at superatmospheric pressure. Suspended from the lid by means of a shaft was a magnetically rotated stirrer and a cup for containing a sample of dried coated granules; 1.5 g of each batch of coated granules was placed in turn in the cup and the vessel was sealed and placed under pressure. The valve at the base portion of the vessel was then opened for a time sufficient to draw off 7–8 ml of dead liquid which had passed through the membrane. With the magnetic stirrer rotating, the vessel was shaken to transfer the granules from the cup into the later and a stop watch was started. At given intervals there was run off from the base portion of the vessel firstly 7–8 ml of dead liquid, then 7–8 ml of a sample which was tested for percentage absorption of ultraviolet light of wavelength 269 nm in an ultraviolet spectrophotometer. The particular amylase enzyme used was found to absorb strongly at a wavelength of 269 nm and the percentage absorption of radiation of this wavelength therefore gave a measure of the concentration of amylase in solution. A graph was drawn of percentage absorption against time and a value was obtained for "$t_{50}$", the time at which the percentage absorption was 50% of the maximum percentage absorption obtainable.

As a comparison a value of $t_{50}$ was also obtained for the uncoated enzyme granules.

The results obtained are set forth in table I below:

TABLE I

| Coating Clay mineral | Binder | Percentage by weight of binder on granules | $t_{50}$ (mins.) |
|---|---|---|---|
| None | — | — | 0.20 |
| A | Water | — | 0.20 |
| A | SBR latex | 2.6 | 0.35 |
| A | SBR latex | 13.4 | 0.65 |
| None | SBR latex | 16.8 | 2.0 |
| B | OMS | 11.0 | 1.0 |
| B | SBR latex | 10.0 | 0.9 |

These results show that with an organophilic clay mineral B in accordance with the invention less binder is required to produce a significant reduction in the rate of dissolution of the enzyme granules as compared with a coating of a hydrophilic clay mineral A.

EXAMPLE 2

A suspension of an organophilic clay mineral in odourless mineral spirit (OMS) was prepared by first adding 7.2 ml of propylene carbonate, as a polar activator, to 315 g of OMS in a 1 liter paint tin. There was then poured slowly into this mixture, which was continuously stirred by means of a small Cowles blade rotating on a laboratory stirrer at 4000 rpm, 31.5 g of an organophilic clay mineral which had been prepared by treating a Wyoming sodium bentonite with sufficient 2M2HT to provide 95 milliequivalents of 2M2HT per 100 g of dry bentonite and which had a particle size distribution such that 95% by weight passed through a No. 200 mesh British Standard sieve. Mixing was continued for 15 minutes after the addition of the clay mineral was complete.

Next, 100 g of the same enzyme granules as were used in Example 1 were tumbled in the pan granulator and known weights of the organophilic clay mineral suspension were sprayed on to the granules until the granules were well moistened and started to stick together. The coated granules were then dried in the vacuum oven at 60° C. The coating procedure was then repeated until a sufficient layer of the organophilic clay mineral had been built up.

Samples of one coated granules were then tested as described in Example 1 above to determine the $t_{50}$ for the enzyme. The results obtained are set forth in Table II below:

TABLE II

| Percentage by weight of organophilic clay mineral on granules | $t_{50}$ |
|---|---|
| 0.24 | 0.30 |
| 0.93 | 0.80 |
| 1.80 | 2.5 |

These results show that comparable reductions in the rate of dissolution of the enzyme to those obtained in Example 1 are obtainable with very much smaller amounts of the organophilic clay mineral if the organophilic clay mineral is well dispersed.

EXAMPLE 3

In this example, 100 g batches of enzyme granules, which were similar to those used in Example 1 except that the amylase concentrate was of higher activity and different binder and pelletiser were used so that the rate of dissolution of enzyme from the uncoated granules was less rapid, were mixed in the pan granulator with 7 g of the same organophilic clay mineral as was used in Example 1B using OMS or different amounts of SBR latex as the binder. In each case the value of $t_{50}$ for the rate of dissolution of the enzyme was determined as described in Example 1.

As a comparison the value of $t_{50}$ for the uncoated enzyme granules was also determined.

The results are set forth in Table III below:

TABLE III

| Binder | Percentage by weight of binder on granules | $t_{50}$ |
|---|---|---|
| OMS | 11.0 | 4.0 |
| SBR latex | 1.8 | 2.8 |
| SBR latex | 5.8 | 4.0 |
| SBR latex | 9.4 | 3.0 |
| None | — | 1.5 |

EXAMPLE 4

In this Example, 100 g of the same enzyme granules as were used in Example 3 were rotated in the pan granulator and were sprayed with a suspension in ordourless mineral spirit of the same organophilic clay mineral as was used in Example 1. The suspension was prepared by first adding 7.2 ml of propylene carbonate to 315 g. of OMS in a 1 liter paint tin. Next, 31.5 g of the organophilic clay mineral was poured slowly into this mixture, which was continuously stirred by means of a small Cowles blade rotating on a laboratory stirrer at 4000 rpm. The mixing was continued for 15 minutes after the addition of the clay mineral was complete. A known weight of the suspension was sprayed on to the granules until the granules were well moistened and

United States Patent Office

PTO - BOYERS, PA Duty Station

MISSING PAGE TEMPORARY NOTICE

PATENT # 4,999,125 FOR ISSUE DATE 3-12-91

HAS BEEN SCANNED, BUT WITH MISSING PAGE(S). UPON RECEIVING OF MISSING PAGE(S), THE ENTIRE DOCUMENT WILL RE RESCANNED. PLEASE CALL IMAGE DATA ADMINISTRATION STAFF OF 557-6154 IF YOU HAVE A QUESTION. ASK FOR DAVE GROOMS, ANITA YOUNG OR POLA JONES.

THIS NOTICE IS FOR THE MISSING PAGE CONTAINING:

COLUMN # 7 to end

N/A at Boyers
7/30/92

Data Conversion Operation

Boyers, Pa